US007182477B1

(12) United States Patent
Hartz

(10) Patent No.: US 7,182,477 B1
(45) Date of Patent: Feb. 27, 2007

(54) ILLUMINATORS FOR SPRINKLER SYSTEMS

(76) Inventor: Gary E. Hartz, 14941 Waverly La., Irvine, CA (US) 92604

( * ) Notice: Subject to any disclaimer, the term of this patent is extended or adjusted under 35 U.S.C. 154(b) by 36 days.

(21) Appl. No.: 10/863,478

(22) Filed: Jun. 8, 2004

Related U.S. Application Data

(60) Provisional application No. 60/477,444, filed on Jun. 9, 2003.

(51) Int. Cl.
*F21V 33/00* (2006.01)
*F21S 6/00* (2006.01)

(52) U.S. Cl. ..... 362/96; 362/124; 40/412; 446/485; 239/18; 222/113; 222/159

(58) Field of Classification Search ..... 362/124, 362/96, 191, 808, 800, 806, 122, 123; 40/411–420; 446/392, 485; 239/18, 16, 33; 222/113, 222/159
See application file for complete search history.

(56) References Cited

U.S. PATENT DOCUMENTS

| | | | | | |
|---|---|---|---|---|---|
| 3,174,688 | A | | 3/1965 | Chatten | |
| 4,564,889 | A | * | 1/1986 | Bolson | 362/192 |
| 4,749,126 | A | * | 6/1988 | Kessener et al. | 239/12 |
| 4,789,572 | A | * | 12/1988 | Weaver | 428/26 |
| 4,936,506 | A | * | 6/1990 | Ryan | 239/18 |
| 4,945,765 | A | | 8/1990 | Kendrick | |
| 4,975,811 | A | | 12/1990 | Fraser et al. | |
| 5,505,380 | A | * | 4/1996 | Jun | 239/211 |
| 5,526,243 | A | * | 6/1996 | Masters | 362/122 |
| 5,823,431 | A | | 10/1998 | Pierce | |
| 5,829,862 | A | * | 11/1998 | Ferrell | 362/554 |
| 6,132,056 | A | * | 10/2000 | Ruthenberg | 362/96 |
| 6,250,565 | B1 | * | 6/2001 | Ogie et al. | 239/211 |
| 6,305,618 | B1 | * | 10/2001 | Lin | 239/284.1 |
| 6,364,501 | B1 | * | 4/2002 | Tai | 362/122 |
| 6,439,472 | B1 | * | 8/2002 | Lin et al. | 239/18 |
| 6,474,507 | B1 | * | 11/2002 | Hornsby et al. | 222/79 |
| 6,513,945 | B1 | * | 2/2003 | Wyss et al. | 362/34 |
| 6,537,130 | B1 | * | 3/2003 | Lee et al. | 446/375 |
| 6,547,418 | B1 | * | 4/2003 | Hsu | 362/249 |
| 6,761,323 | B2 | * | 7/2004 | Hsieh | 239/284.1 |
| 6,805,458 | B2 | * | 10/2004 | Schindler et al. | 362/96 |
| 2004/0032479 | A1 | | 2/2004 | Schindler et al. | |
| 2004/0095751 | A1 | | 5/2004 | Pan | |

* cited by examiner

*Primary Examiner*—Sandra O'Shea
*Assistant Examiner*—Jacob Y. Choi
(74) *Attorney, Agent, or Firm*—Richard S. Erbe

(57) ABSTRACT

A device for providing illumination in conjunction with a sprinkler system has a body with an opening through it and at least one appendage extending from the body. The device takes on the appearance of a living thing, such as a flower, creature, or three-dimensional art.

The opening in the body allows for the passage of liquid from the sprinkler system through the illuminator and provides a means for mounting the device near plants and flowers. A light source, preferably a light emitting diode, is embedded in the device itself and provides the illumination source.

The opening includes a roughened surface along a portion of its length, which helps to refract the light emitted from the light source and adds to the quality of the display. A pivoting head assembly allows a user to adjust the pattern of liquid spray and also provides an easy means of maintenance.

21 Claims, 4 Drawing Sheets

ILLUMINATORS FOR SPRINKLER SYSTEMS

RELATED APPLICATIONS

This application claims the benefit of U.S. Provisional Patent Application No. 60/477,444, filed Jun. 9, 2003, incorporated herein by reference.

BACKGROUND OF THE INVENTION

1. Field of the Invention

The present invention relates to illuminating devices, and more specifically, to low energy illuminating devices that have the flexibility to be used by them or in conjunction with conventional water sprinkling systems if so desired.

2. General Background and State of the Art

Illuminating devices come in many shapes and sizes and are used for a multitude of purposes. Some illuminating devices may be used strictly for decorative or ornamental display purposes, while other illuminating devices may be used for security purposes to more effectively light pathways and other areas in which people walk. Illuminating devices are also known for use with liquid systems, either for display purposes or for use with sprinkler systems for lawns and gardens to enhance the aesthetic qualities of homes, public parks and other venues where flowers and other forms of plants are displayed.

several prior art illumination devices are known that have been designed for use with liquid display or sprinkler systems. U.S. Pat. No. 3,174,688 to Chatton discloses a device that includes a number of inclined wires to which small amounts of liquid is applied. The liquid travels downward in the form of droplets by the force of gravity along the wires. Fluorescent materials may be added to the liquid. An incandescent light is directed at the wires and the liquid traveling down the wires, resulting in an ornamental display primarily because of the fluorescents that were added to the liquid. Chatton does not disclose or suggest using the device in conjunction with a watering system for plants and lawns, or even for use as a security device.

U.S. Pat. No. 4,945,675 to Kendrick discloses a divider system for use in illuminating lawns or flower beds. A system of dividers is arrayed in the lawn or flower beds. The dividers include plumbing and sprinkler heads within the body of the dividers to water the lawn or flowers. Lighting fixtures are separately installed at intervals along the divider to provide illumination. Kendrick does not disclose or suggest an illuminating device where lighting and watering of plants is accomplished by a single integrated component. Kendrick does not disclose or suggest that the device may be used as a security device.

U.S. Pat. No. 4,975,811 to Fraser, et al. discloses a device for developing a curtain of liquid droplets through which a light is shined to simulate rainbows. Fraser, et al. does not disclose or suggest an illuminating device that may be used in conjunction with a watering system for plants or as a security device.

U.S. Pat. No. 5,823,431 to Pierce discloses an illuminating device for use with sprinkler systems for lawns. The device includes a sprinkler system with a separate light that shines on the water as it is dispersed on the lawn to create aesthetically pleasing illuminated water patterns. Pierce does not disclose or suggest an illuminating device where lighting and watering of plants is accomplished by a single integrated component.

A number of problems exist with these prior art illuminating devices. Many of them use high energy incandescent lighting that emits ultraviolet light which is not only highly inefficient, but is also known to attract insects.

Another problem with prior art illuminating devices that can be used in conjunction with watering systems is that they are expensive to make and maintain.

Another identified problem with prior art illuminating devices, especially those used in conjunction with sprinkler systems is that many are difficult to see, especially during daylight hours, and are vulnerable to being damaged by foot traffic in the vicinity of the devices. These prior art illuminating devices are usually constructed using conventional materials, without having any additional features to enhance their visibility or brightness.

There exists, therefore, a need for an illuminating device that can be used in conjunction with sprinkler systems that is highly efficient in its use of electrical power.

There also exists a need for an illuminating device that can also serve as an integral part of a sprinkler system for controlling spray patterns on lawns, gardens and flowers.

There also exists a need for an illuminating device that is inexpensive to make and easy to maintain.

There also exists a need for an illuminating device that includes integral design features to enhance the visibility and brightness of the device.

None of the above devices, either by themselves or in combination, is seen to anticipate or suggest the illuminating device disclosed and claimed herein.

SUMMARY OF THE INVENTION

Accordingly, it is an object of the invention to provide an illuminating device that can be used for ornamental or decorative purposes.

It is another object of the invention to provide an illuminating device that can be used for security applications such as lighting dark areas.

Another object of the invention is to provide an illuminating device that can be used in conjunction with conventional watering and sprinkling systems.

Still another object of the invention is to provide an illuminating device that is very efficient in its use of electrical energy.

Another object of the invention is to provide an illuminating device that can be used in conjunction with renewable energy sources, such as solar energy.

An additional object of the invention is to provide an illuminating device that is very effective and efficient in how it uses water when used in conjunction with conventional watering or sprinkling systems.

It is yet another object of the invention to provide an illuminating device that emits light that does not attract insects.

A further object of the invention is to provide an illuminating device that is highly visible and thus less likely to be accidentally damaged by someone walking in the vicinity of it.

Another object of the invention is to provide an illuminating device that when used in conjunction with conventional watering or sprinkling systems that provides easy means for adjusting the spray of water to make the most efficient use of it.

Still another object of the invention is to provide an illuminating device that is very durable.

Yet another object of the invention is to provide an illuminating device that can be produced in a variety of shapes.

A further object of the invention is to provide an illuminating device that is inexpensive to manufacture.

It is also an object of the invention to provide an illuminating device having integral design features that enhance the dispersion of the light to provide a more aesthetically-pleasing appearance as well as being highly visible.

Another object of the invention is to provide an illuminating device that is easy and inexpensive to maintain.

A further object of the invention is to provide an illuminating device that integrates lighting and watering functions into a single component.

It is another object of the invention to provide an illuminating device that is effective whether or not it is used in conjunction with a conventional watering or sprinkling system.

These and other objectives are achieved by the present invention, which, in a broad aspect, provides the owner with an illuminator that, in the preferred embodiment of the invention, is constructed of a durable molded plastic that simulates a living thing, such as an insect, a fish or a bird. This type of construction makes it inexpensive to produce the illuminator of the present invention. The illuminator contains an embedded light source, which in the preferred embodiment of the invention is a light emitting diode (LED).

The use of an LED in the illuminator of the present invention is important for several reasons. First, LED's are brighter (more efficient) than most lights found in illuminators used in conjunction with watering and sprinkling systems, thus providing a more pleasing display or better lighting when used in a security or decorative application. LED's do not emit UV radiation and thus do not attract insects. LED's use about 1-20$^{th}$ of the electrical energy of conventional illuminators, thus meaning the illuminator of the present invention provides a very energy efficient device. LED's also tend to have a longer life than do conventional light sources, meaning replacement costs for a system using the illuminator of the present invention is lower than in other systems. Because of the lower power requirements of the illuminator of the present invention, it may be used in conjunction with renewable energy sources, such as solar power devices.

When used in conjunction with watering or sprinkling systems, the illuminator of the present invention includes an opening through it to allow the illuminator to be mounted on conventional tubing while also providing for a passageway for liquid through it. The tubing holding the illuminator is then generally secured to a stake, plant pot, or side of a building. The opening in the illuminator is positioned near the embedded light source to enhance the refraction and dispersion of the light coming from the light source, thus providing a very aesthetically-pleasing display. The surface of the opening may be roughened for a portion of its length to add to the refraction of the light from the LED, further enhancing the brightness and aesthetic qualities of the illuminator.

A separate tube may be inserted into the opening in the body to create added effects or even change the coloring. The tube may also have its surfaces patterned to enhance the ability of the illuminator to refract and disperse light and add to the aesthetic features of the illuminator.

Although the illuminator of the present invention may be fabricated as a single piece, a person viewing it will see what looks like a distinctive body, head, and appendages or wings extending away from the body. The appendages of the illuminator have a number of features to enhance the ability of the illuminator to disperse and refract the light. The top surface of an appendage is generally convex in shape, while the bottom surface of an appendage includes beveling.

In the preferred embodiment of the invention, the beveling on the bottom surface of an appendage is cut to a depth of between 0.01 to 0.05 inches, and the beveling is angled in relation to the longitudinal axis of the appendage.

The illuminator of the present invention also includes a removable head assembly that can adjust the angle and breadth of liquid spray when used in conjunction with watering or sprinkling systems. The head assembly includes a hollow stem portion attached to a ball. The stem is inserted into the opening in the illuminator body and secured to the body by means of threads or a twist lock. The ball includes a number of apertures that form spray nozzles, each one designed for a different spray pattern. A head piece with a slot snaps over the ball. The head piece can be pivoted to align the slot with one of the spray nozzles to obtain the desired spray pattern. The head assembly may provide a variety of spray patterns, including two separate sprays angled in relation to each other. In the event that the illuminator becomes clogged, the head assembly can be removed and cleaned and then replaced, making maintenance easy and inexpensive.

While much of the present discussion focuses on the use of the illuminator of the present invention in conjunction with watering or sprinkling systems, those skilled in the art will recognize that the illuminator may be used effectively to light displays, walkways, buildings and the like without the need for liquids passing through it.

Further objects and advantages of this invention will become more apparent from the following description of the preferred embodiments, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

In the following description of the present invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

Figure 1:
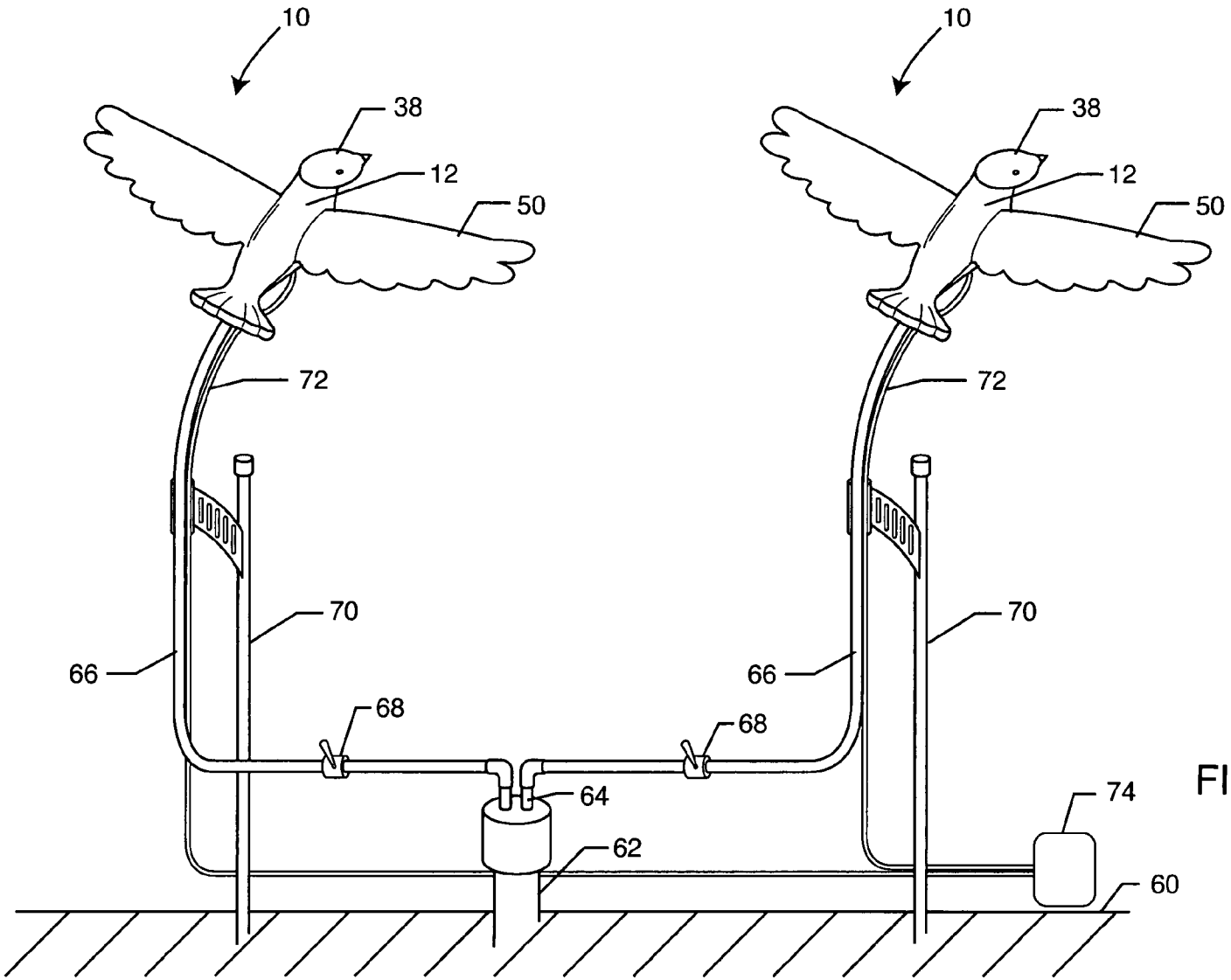
FIG. 1 illustrates a perspective view of an exemplary illuminator in accordance with the present invention, showing the invention as it is used with a watering or sprinkling system for plants and flowers.
Figure 2:
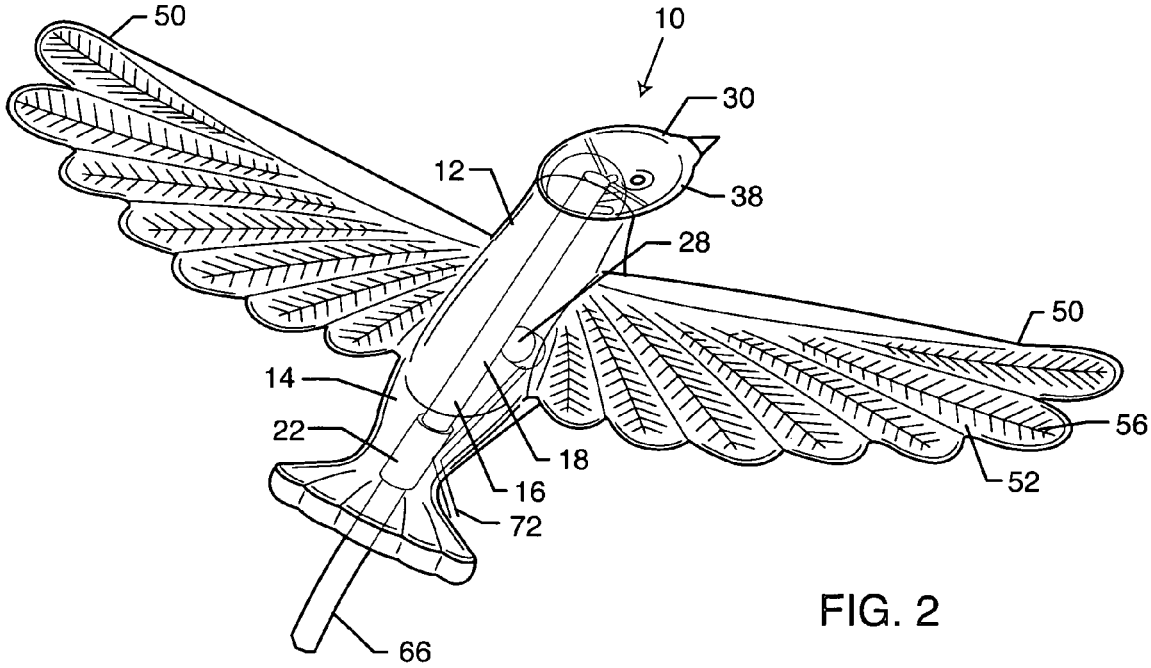
FIG. 2 illustrates a perspective view of an exemplary illuminator in accordance with the present invention.
Figure 3:
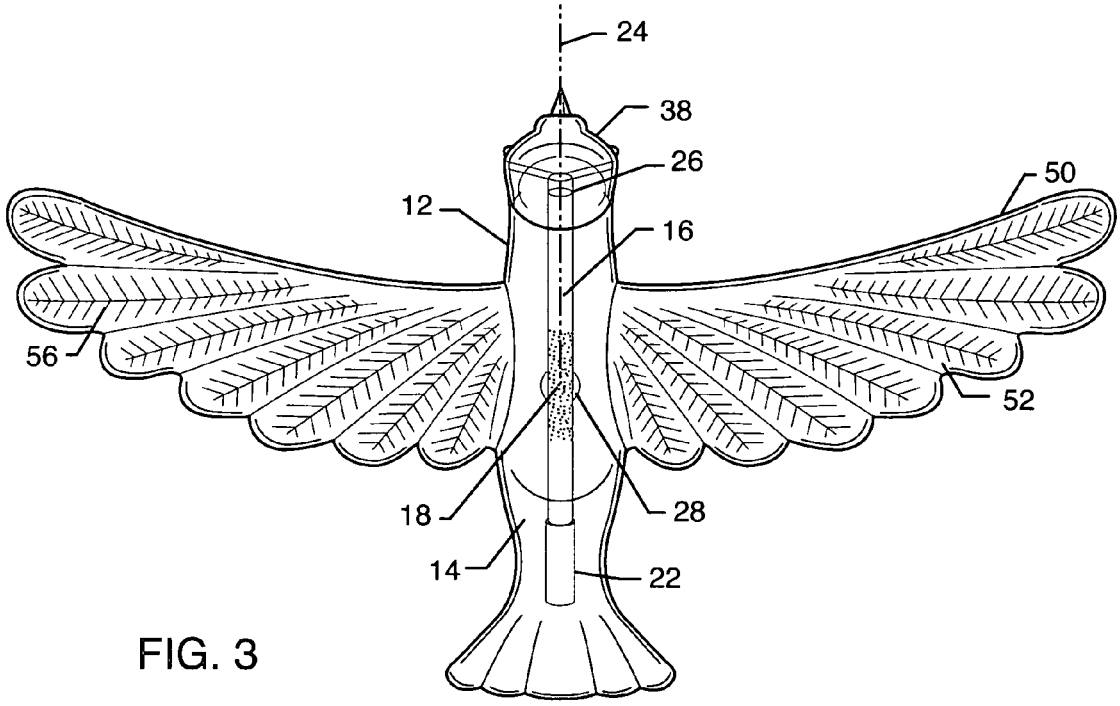
FIG. 3 illustrates a plan view of an exemplary illuminator according to the present invention.

An illuminator according to the present invention is generally referred to by the reference numeral 10. FIG. 1 illustrates one use of the illuminator 10 of the present invention in conjunction with a conventional watering or sprinkling system for lawns and gardens. Those skilled in the art will recognize that the illuminator of the present invention may be used in other applications that do not include a watering function without departing from the scope of the invention.

In FIGS. 1–8, illuminators 10 take on the form of a living thing. The illustrative figures all show illuminator 10 in the form of a bird, but illuminator 10 can take on many other forms, such as butterflies, dragonflies, fish, flowers and the like. In the preferred embodiment of the invention, illuminator 10 is constructed of a clear molded plastic that is resistant to damage from ultraviolet radiation, and thus provides a long-lasting product with low replacement costs for the owner. Illuminator 10 may be constructed of translucent colored plastic as well to enhance the aesthetic appeal of the device.

Illuminator 10, as used for a sprinkler system application as illustrated in FIG. 1, may be mounted on tubing 66 and attached to support structure 70, which may be a stake, a wall, a building, or other support structure. The sprinkler system of the conventional design includes supply pipe 62 partially located below grade 60. Outlets 64 divide the supply of sprinkler liquid to the illuminators 10. Each line of tubing 66 also includes flow adjuster 68 for regulating the flow of water to illuminator 10. Power source 74 provides electrical power through wires 72 to the light source located in illuminator 10; as illustrated in FIG. 1, power source 74 is provided by household current, but power to illuminator 10 may be provided from renewable energy sources, such as solar power. Solar power sources can be easily integrated into a system using illuminator 10 because of its low power requirement, as will be further discussed, and its location outdoors.

Figure 5:
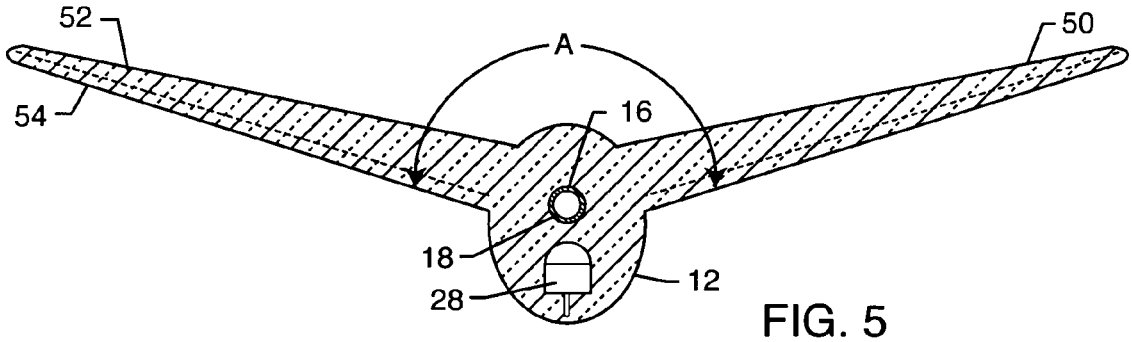
FIG. 5 illustrates a sectional view taken at line 5—5 in FIG. 4.
Figure 6:
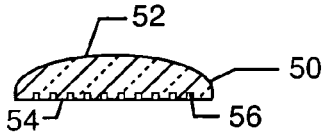
FIG. 6 illustrates sectional view taken at line 6—6 in FIG. 4.
Figure 7:
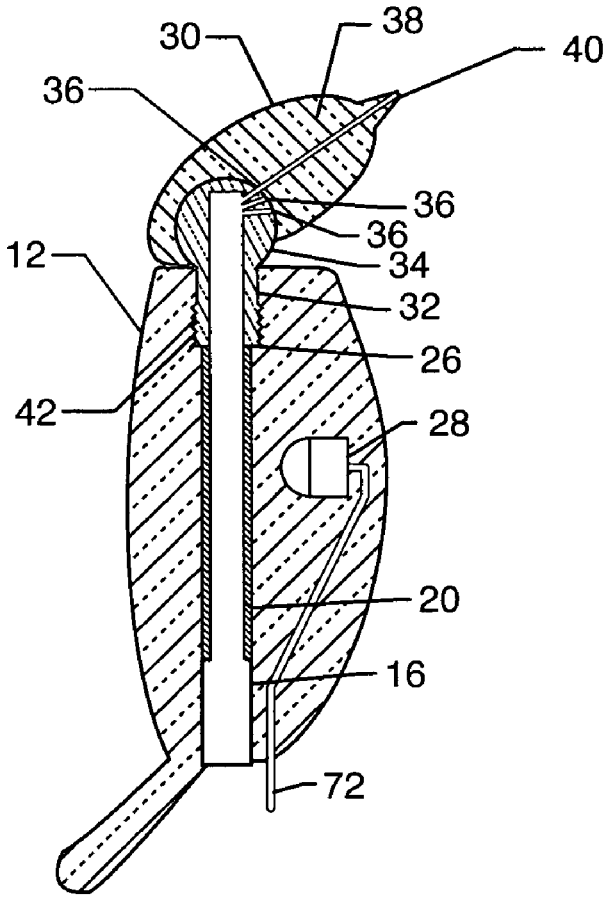
FIG. 7 illustrates a sectional view taken at line 7—7 in FIG. 4.

FIGS. 2 through 8 illustrate illuminator 10 and its features in more detail. Illuminator 10 includes a body 12 having an outer surface 14. Aperture 16 extends along axis 24 through the length of body 12 and provides a passageway for liquid when illuminator 10 is used for watering and sprinkling applications. Aperture 16 may also include a roughened portion 18, which enhances the refraction of light emanating from light source 28 in body 12. The surface roughening can be accomplished by inserting a shaped insert in aperture 16 during fabrication and retracting the insert prior to the completion of the fabrication process. Alternatively, as best illustrated in FIG. 7, the inventor has found that inserting a refracting tube 20 into aperture 16 can also produce desirable lighting effects.

Mounting sleeve 22 in body 12 provides a means for incorporating illuminator 10 into a sprinkling or watering system by allowing illuminator 10 to be mounted on tubing 66. The inventor has found that by inserting a thin wire or metal tube (not shown) inside tubing 66, or along the exterior of tubing 66, illuminator 10 provides a means that allows the owner to adjust the position of illuminator 10 to provide for the most efficient use of the water.

Light for illuminator 10 is provided by an integral light source 28 within body 12. In the preferred embodiment of the invention, light source 28 is a light emitting diode (LED). LED's provide a very bright light source in a variety of colors. Because LED's are quite efficient in their use of power, replacement costs for an illuminator of the present invention are lower than for other known illuminators. This quality also enables illuminators of the present invention to be used with conventional as well with renewable energy sources, such as solar power. The inventor has found that orienting light source 28 so that it is perpendicular to axis 24 enhances the ability of illuminator 10 to effectively refract the light emanating from light source 28 and thereby providing a pleasing display.

In the preferred embodiment of the invention, illuminator 10 includes one or more appendages 50 extending from body 12. As depicted in FIGS. 1–5, appendages 50 take on the appearance of wings. Each appendage 50 includes key features for enhancing the quality of the display provided by illuminator 10.

Appendage 50 includes top surface 52, which, as best illustrated in FIG. 6, is generally configured to be a convex shape. The inventor has found that providing a convex shape in top surface 52 of appendage 50 enhances the ability of illuminator 10 to refract the light from light source 28, thereby adding to the aesthetic features of the display.

Figure 4:
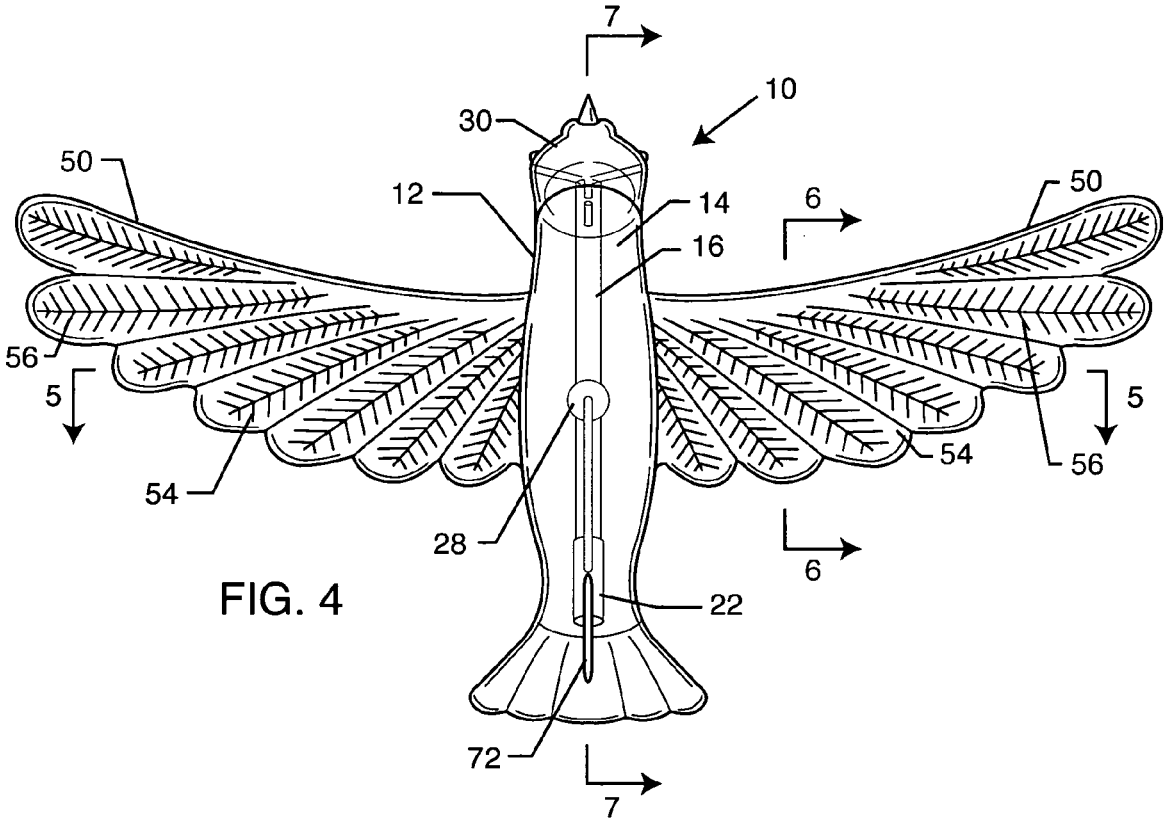
FIG. 4 illustrates a bottom view of an exemplary illuminator in accordance with the present invention.

FIGS. 4 and 6 illustrate another key feature of appendage 50 in the form of beveling 56 in bottom surface 54 of appendage 50. Beveling may be cut to depths of between 0.01 to 0.05 inches for maximizing the refraction of light emanating from light source 28.

FIG. 5 illustrates the relationship between a pair of appendages 50 extending from body 12 when illuminator 10 takes on the configuration of a hummingbird. The inventor has found that when angle "A" between appendages 50 is between 120 to 160 degrees, the ability of illuminator 10 to provide an aesthetically pleasing display is optimized, although other angles are possible without departing from the scope of the invention.

Figure 8:
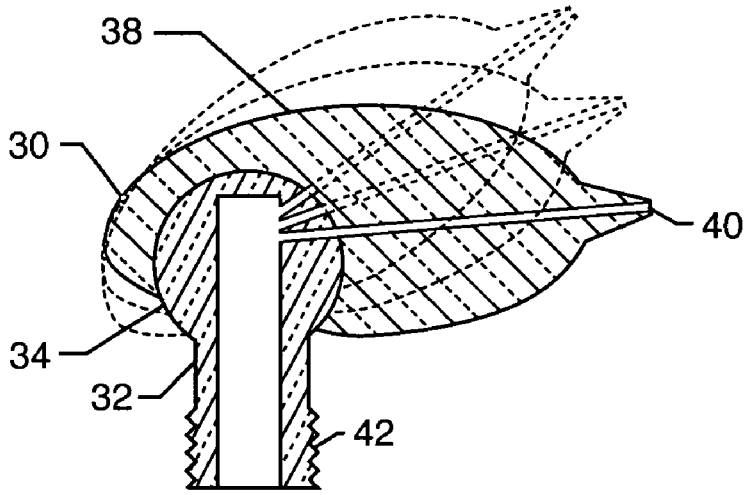
FIG. 8 illustrates a detailed view of the sprayer assembly of an exemplary illuminator in accordance with the present invention.

FIGS. 7 and 8 illustrate another feature of the illuminator of the present invention for when illuminator 10 is used in conjunction with watering or sprinkling systems. Illuminator 10 includes a spray assembly 30 for mounting on body 12. Spray assembly 30 includes a hollow stem 32 and a ball 34. Stem 32 includes a threaded portion 42 or twist lock for securing sprayer assembly 30 in threaded receptacle 26 of aperture 16.

Incorporated in ball 34 are a plurality of nozzles 36, which are in fluid communication with aperture 16 by means of stem 32. Each nozzle 36 is constructed to provide a particular spray pattern of liquid. These spray patterns may be from a very narrow width pattern to a very wide pattern, to a pattern that may provide one or more distinctive pathways for liquid.

Head 38 of spray assembly 30 is designed to snap on ball 34 and provide a very close fit. Slot 40 in head 38 provides an exit for liquid flowing through one of the nozzles 36 when slot 40 is aligned with it. Head 38 is designed to be pivoted about ball 32 so that slot 40 may be aligned with a desired nozzle 36 to allow the user to select a spray pattern of liquid as the user prefers.

Spray assembly 30 provides the added advantage of easy maintenance when illuminator 10 is used with a watering or sprinkler system. If the illuminator becomes plugged, spray assembly 30 may be removed from body 12 and head 38 may then be removed from ball 34 and stem 32. Nozzles 36 and/or slot 40 may be cleared and the spray assembly either reattached to body 12 or replaced. Either way, maintenance of a watering or spraying system incorporating an illuminator 10 of the present invention is easy, quick, and inexpensive.

The foregoing description of exemplary embodiments of the present invention has been presented for purposes of enablement, illustration, and description. It is not intended to be exhaustive of or to limit the present invention to the precise forms discussed. There are, however, other configurations for illuminating devices not specifically described herein, but with which the present invention is applicable. The present invention should therefore not be seen as limited to the particular embodiments described herein; rather, it should be understood that the present invention has wide applicability with respect to illuminating devices. Such other configurations can be achieved by those skilled in the art in view of the description herein. Accordingly, the scope of the invention is defined by the following claims.

What is claimed is:

1. An illuminator comprising:

a clear solid body having an outer surface and opposed first and second ends;

a tubular passageway in said body extending along an axis between said first and second ends for conducting water between said first and second ends;

a single embedded light source mounted within said body adjacent said passageway and disposed between said first and second ends to illuminate the illuminator; and at least one appendage attached to and extending away from said body along an axis of said appendage, said appendage further having a top surface and a bottom surface.

2. The illuminator according to claim 1, wherein said passageway further includes a light refracting roughened surface along a portion of the passageway.

3. The illuminator according to claim 1, further comprising a light refracting tube mounted within said passageway.

4. The illuminator according to claim 1, wherein said top surface of said at least one appendage has a convex shape to refract the light emitted by the light source.

5. The illuminator according to claim 4, wherein said bottom surface of said at least one appendage includes a plurality of grooves to refract the light emitted by the light source.

6. The illuminator according to claim 1, wherein said bottom surface of said at least one appendage includes a plurality of grooves to refract the light emitted by the light source.

7. The illuminator according to claim 6 wherein said grooves are between 0.01 to 0.05 inches in depth in relation to said bottom surface.

8. The illuminator according to claim 1, further comprising a head removable from said body.

9. The illuminator according to claim 1, wherein said embedded light source is oriented to be perpendicular to said axis and directed toward said tubular passageway.

10. An illuminator comprising:

a clear molded plastic solid body having an outer surface and opposed first and second ends;

a tubular passageway in said body extending along an axis between said first and second ends for conducting water between said first and second ends;

a plurality of appendages attached to and extending away from said body, each of said appendages further extending along an axis and having a top surface and a bottom surface; and a single embedded light source mounted within said body adjacent said passageway between said first and second ends and disposed between said first and second ends to illuminate the illuminator, whereby, light emitted by the light source is caused to be dispersed by the passage of water through the passageway.

11. The illuminator according to claim 10, wherein said passageway further includes a light refracting roughened surface along a portion of the passageway.

12. The illuminator according to claim 10, further comprising a light refracting tube mounted within said passageway.

13. The illuminator according to claim 10, wherein said light source is a light emitting diode.

14. The illuminator according to claim 10, wherein said top surface of each of said appendages has a convex shape to refract the light emitted by the light source.

15. The illuminator according to claim 14, wherein said bottom surface of each of said appendages includes a plurality of grooves to refract the light emitted by the light source.

16. The illuminator according to claim 15, wherein said grooves are between 0.01 to 0.05 inches in depth in relation to said bottom surface.

17. The illuminator according to claim 10, wherein said bottom surface of each of said appendages includes a plurality of grooves to refract the light emitted by the light source.

18. The illuminator according to claim 10, wherein said light source is oriented to be perpendicular to said axis of said passageway and directed toward said tubular passageway.

19. The illuminator according to claim 10, wherein the axes of at least two of said appendages are disposed at an angle between 120 degrees and 160 degrees in relation to each other.

20. The illuminator according to claim 10, further comprising a liquid spraying head assembly mounted on said body.

21. The illuminator according to claim 20, wherein said spraying head assembly comprises:

a hollow stem insertable into said passageway;

a ball portion attached to said stem, said ball having a plurality of patterned spray nozzles extending through the ball to said stem; and a pivotable head portion configured to closely fit over said ball portion, said pivotable head portion further having a slot, whereby, said slot my be aligned with a selected one of said patterned spray nozzles by pivoting said head portion.

* * * * *